United States Patent [19]

Bachler et al.

[11] 4,121,430

[45] Oct. 24, 1978

[54] CRYOPUMP HAVING IMPROVED HEAT RADIATION SHIELDING

[75] Inventors: Werner Bächler, Hoffnungsthal; Hans-Joachim Forth; Rudiger Frank, both of Cologne, all of Fed. Rep. of Germany

[73] Assignee: Leybold-Heraeus GmbH & Co. KG, Cologne, Fed. Rep. of Germany

[21] Appl. No.: 793,488

[22] Filed: May 4, 1977

[30] Foreign Application Priority Data

May 11, 1976 [DE] Fed. Rep. of Germany ..... 2620880

[51] Int. Cl.[2] ..... B01D 5/00

[52] U.S. Cl. ..... 62/55.5; 62/268; 417/153

[58] Field of Search ..... 62/55.5, 100, 268; 55/269; 417/153

[56] References Cited

U.S. PATENT DOCUMENTS

| | | | |
|---|---|---|---|
| 3,122,896 | 3/1964 | Hickey | 62/55.5 |
| 3,252,652 | 5/1966 | Trendelenburg | 62/55.5 |

*Primary Examiner*—Allen M. Ostrager
*Attorney, Agent, or Firm*—Spencer & Kaye

[57] ABSTRACT

A cryopump having a generally axially symmetrical housing provided at one end with an entrance opening defined by a plane for passage of molecules of the gas to be pumped and plates defining condensation surfaces arranged to be brought to low temperature for condensation of molecules of the gas to be pumped, and a thermal radiation shield disposed in the region of the entrance opening, with the condensation surfaces being oriented substantially at right angles to the plane of the entrance opening and the radiation shield being composed of a plurality of elongate metal strips so positioned that their longitudinal axes are parallel to the condensation surfaces.

9 Claims, 2 Drawing Figures

CRYOPUMP HAVING IMPROVED HEAT RADIATION SHIELDING

BACKGROUND OF THE INVENTION

The present invention relates to cryopumps of the type having condensation surfaces disposed in their housing and a shield against heat radiation disposed in their inlet region of the pump.

Cryopumps of this type which have substantially axially symmetrical configurations, are disclosed in Austrian Pat. No. 242,409 and German Offenlegungsschrift [Laid Open Application] No. 1,938,035. Their pumping action involves condensation of the gases being pumped on cooled surfaces. The lower the temperature selected for the condensation surfaces, the better is the pumping effect. The amount of energy required to produce the cold temperatures, however, significantly increases when lower temperature values are sought because of the greater losses resulting from heat conduction and heat radiation reaching the condensation surfaces. It is therefore known to provide cooled shields to protect against heat radiation.

These shields for the most part are designed as closed jackets. However, in the entrance region of the pump, the shield must be designed to enable the gases which are to be withdrawn to enter the pump.

Therefore, the shielding in this region must meet two mutually contradictory requirements. On the other hand, it must obturate the condensation surfaces as completely as possible so that no heat radiation can go directly from the receptacle to be evacuated to the condensation surfaces; on the other hand, the shield should interfere as little as possible with the flow of the gases from the receptacle to the pump. At the pressures that can be realized with cryopumps the known radiation shields, which have an axially symmetrical configuration adapted to the likewise axially symmetrical condensation surfaces, constitute a constriction, or bottleneck, which substantially adversely influences the suction capability of the pump.

SUMMARY OF THE INVENTION

It is therefore an object of the present invention to construct such a cryopump in a novel manner such that, with respect to the quantity of cold producing energy required, it has significantly improved pumping properties and moreover is of a simple design and can therefore be manufactured at low cost.

These and other objects are achieved according to the invention, in a cryopump composed of a housing presenting an entrance opening defined by a plane for passage of molecules of a gas to be pumped, a member arranged to be brought to low temperature and presenting condensation surfaces for molecules of the gas to be pumped, and a thermal radiation shield disposed in the region of the entrance opening, by positioning the member so that the condensation surfaces are substantially at right angles to the plane of the entrance opening, and constituting the radiation shield of a plurality of elongated metal strips positioned with their longitudinal axes parallel to the condensation surfaces.

The invention is based on the surprising discovery that with such an alteration in the structure of the above-mentioned elements from the prior art axially symmetrical shape, it is possible to realize a number of significant advantages. The shielding which, being adapted to the planar condensation surfaces, is also no longer of axially symmetrical design, does not produce any significant choking of the gases flowing into the pump.

The strips forming the shield can be cooled much more easily and effectively than before since the strips pass through the pump in a linear direction so that both frontal faces are available for soldering to lateral cooling surfaces. This is not possible with axially symmetrical shields so that separate cooling coils must be provided for the shield. Such cooling coils, which have a choking effect on the inflowing gases, can be eliminated in the pump according to the present invention. Practical embodiments of the present invention therefore offer an improvement in the pumping properties as a whole with the same cold output.

Preferably, the metal strips forming the shield in the inlet region are connected directly, and with good thermal contact, with a jacket which forms the lateral shield against incident heat radiation. This arrangment is particularly simple in its structure.

The condensation surfaces are advantageously cooled by a cooling head which is arranged centrally in the cryopump and to which the condensation surfaces are attached in a manner to establish a good thermally conductive contact. The cooling medium may be helium, for example. Advisably, this region of contact is disposed as centrally as possible with respect to the condensation surfaces so that uniform cooling of the entirety of these surfaces is assured.

The number and the manner of arrangement of the plates forming the condensation surfaces is essentially arbitrary. An arrangement of two plates composed of, for example, four sections, has been found to be particularly advantageous where the plates extend through the pump housing in a manner to face one another and are coated with adsorption material only at the inside. A cryopump with these features has a good suction capability not only for nitrogen but also for hydrogen. The nitrogen molecules reaching the interior of the pump condense directly at the outer surfaces which are not covered with adsorption material. The adsorption material in the interior is thus kept substantially free of nitrogen molecules. The lighter hydrogen molecules diffuse into the space formed between the plates and are adsorbed.

DESCRIPTION OF THE PREFERRED EMBODIMENT

Figure 1:
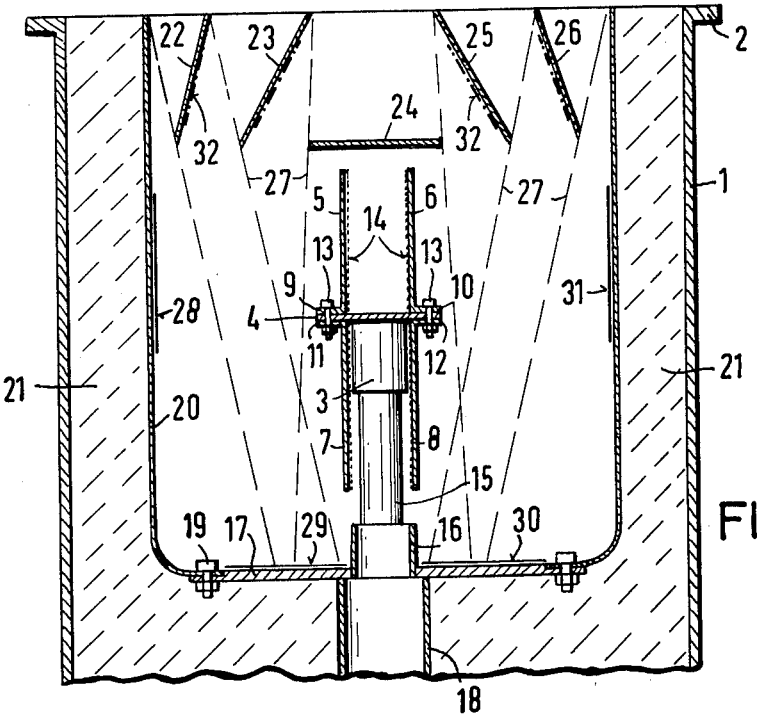
FIG. 1 is a longitudinal, cross-sectional view of a preferred embodiment of a cryopump according to the invention.
Figure 2:
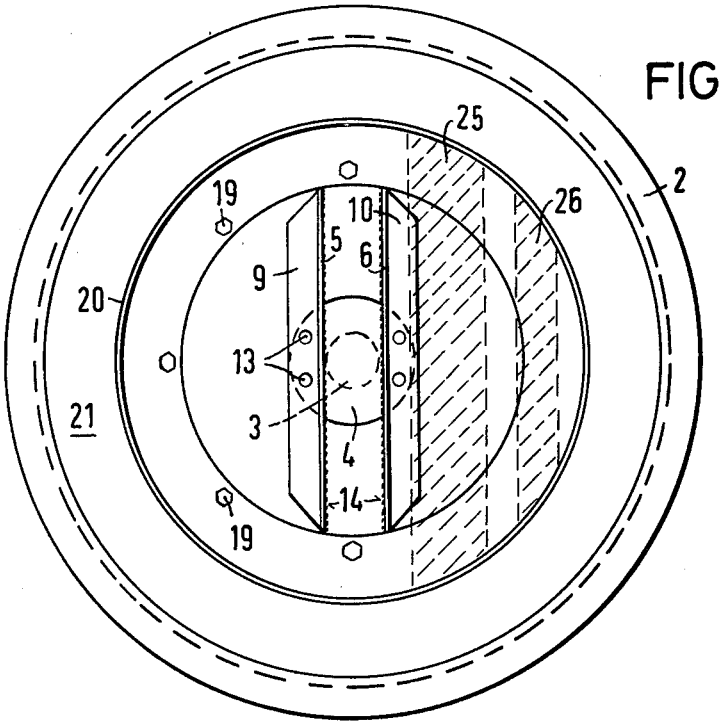
FIG. 2 is a top plan view of the cryopump of FIG. 1 with shielding removed.

FIGS. 1 and 2 illustrate a cryopump composed of a housing 1 arranged to be connected to the bottom of a receptacle which is to be evacuated by means of a flange 2. The configuration of the pump may of course also be selected so that it can be connected to the top or to one side of such receptacle.

Located approximately centrally at the interior of the pump is a cooling head 3 which is provided with a flange 4 at its upper end. A total of four plate sections 5, 6, 7 and 8 are fastened to this flange to form the condensation surfaces. For this purpose each of plates 5 to 8 has an angled portion 9, 10, 11 or 12. These angled portions are held at flange 4 by means of bolts 13. Plates 5-8 are preferably made of silver. At their inside they are covered with suitable adsorption material 14, for example activated charcoal.

The cooling head 3 is supported by a pipe 15 which simultaneously serves to feed in the cooling medium. It is provided with a further cooling section 16 which is in good heat contact with a plate-shaped support 17. For this purpose support 17 is provided with a connecting stud 18 for the flow of cooling medium. An example of a cooling head is described in the Bristish patent specification No. 1,170,824.

A shielding jacket 20 which protects plates 5-8 against laterally impinging heat radiation is secured to plate-shaped support 17 by means of nuts and bolts 19. A further, known, heat insulation 21 is provided between jacket 20 and housing 1. The spacing between plates 5 and 6 is selected to be approximately 1/7 the diameter of jacket 20, this ratio having been found to be particularly advantageous.

The shielding which protects plates 5–8 against heat radiation from the interior of the receptacle is composed of elongate metal strips 22, 23, 24, 25 and 26. These strips pass through the upper region of jacket 20 and their ends are fastened to jacket 20 in a manner to achieve good thermal contact, for example, by soldering. In the top view of FIG. 2 only the locations of the two metal strips 25 and 26 are shown.

The width and inclination of each metal strip are selected so that the two requirements, effective line-of-sight shielding against heat radiation and good flow permeability with respect to gas molecules, are met as well as possible. The broken lines 27 indicate that no heat radiation from the receptacle can impinge directly on plates 5-8.

In order to substantially completely eliminate impingement on plates 5–8 by heat radiation reflected from the interior of the pump, at least regions 28, 29, 30 and 31 of the interior walls of the pump are provided with a black coating which absorbs the heat radiation. The sides of metal strips 22–26 facing plates 5–8 are also given such a black coating represented by dot-dash lines 32. On the other hand, the sides of metal strips 22–26 facing toward the receptacle are made as reflective, or shiny as possible so that impinging heat radiation will be reflected.

According to an advantageous embodiment of the invention, the pump is connected to permit gas molecules to reach its interior and, for example, the temperature of plates 5–8 is kept at approximately 15° to 20° K. Heavier gas molecules, for example of nitrogen, will then condense at the outer surfaces of plates 5–8.

This temperature is not yet sufficient to pump hydrogen, but hydrogen molecules diffuse into the space between the plates and are adsorbed by the adsorption material 14.

The second cooling section 16 may be designed, for example, so that shielding jacket 20 and metal strips 22–26 will be maintained, due to their contact with section 26, at a steady temperature of about 70° to 80° K. With such a selection of temperature values, the pump according to the present invention has been found to have better pumping properties than any comparable prior art cryopump.

The diameter of jacket 20 depends on the diameter of flange 2. For a flange 2 with a diameter of 150 mm the jacket has preferably a diameter of about 140 mm and a height of 170 mm. The distance of the plates 5 and 6 is - as mentioned - approximately 1/2 of the diameter of jacket 20.

It will be understood that the above description of the present invention is susceptible to various modifications, changes and adaptations, and the same are intended to be comprehended within the meaning and range of equivalents of the appended claims.

What is claimed is:

1. In a cryopump of a housing presenting an entrance opening defined by a plane for passage of molecules of a gas to be pumped, a member arranged to be brought to low temperature and presenting planar condensation surfaces for molecules of the gas to be pumped, and a thermal radiation shield disposed in the region of the entrance opening, the improvement wherein said member is positioned so that said condensation surfaces are substantially at right angles to the plane of the entrance opening, and said radiation shield comprises a plurality of elongated metal strips so positioned that their longitudinal axes are parallel to the condensation surfaces.

2. An arrangement as defined in claim 1 further comprising means defining a jacket surrounding the condensation surfaces to constitute lateral heat shielding for insulating the condensation surfaces against incident thermal radiation, and wherein said strips are connected directly to said jacket in a manner to create a thermally conductive connection.

3. An arrangement as defined in claim 1 further comprising a cooling head disposed in said housing and connected to in heat conductive communication with said member for cooling said condensation surfaces, and means providing a thermally conductive connection between said cooling head and said metal strips.

4. An arrangement as defined in claim 3 wherein said cooling head is disposed centrally with respect to said condensation surfaces.

5. An arrangement as defined in claim 1 wherein said member comprises two plates which face one another and extend through the pump housing, the surfaces of said plates which face away from one another constituting said condensation surfaces, and said member further comprising adsorption material covering only the surfaces of said plates which face one another.

6. An arrangment as defined in claim 5 further comprising a jacket of circular cross section surrounding the condensation surfaces and delimiting the interior of said housing, and wherein the spacing between said plates is approximately 1/7 the diameter of said jacket.

7. An arrangement as defined in claim 5 wherein each of said plates is composed of two sections.

8. An arrangement as defined in claim 5 further comprising a cooling head provided with a flange and disposed in said housing and connected in heat conductive communication with said member for cooling said condensation surfaces, and means providing a thermally conductive connection between said cooling head and said metal strip, and wherein each of said plates is provided with an angled portion via which it is connected to said flange.

9. An arrangement as defined in claim 1 wherein portions of the interior wall of said housing and of surfaces of said strips which face said condensation surfaces are blackened for reducing reflection of thermal radiation from inside said housing onto said condensation surfaces.

* * * * *

REEXAMINATION CERTIFICATE (583rd)

United States Patent [19]

Bächler et al.

[11] B1 4,121,430

[45] Certificate Issued Oct. 14, 1986

[54] CRYOPUMP HAVING IMPROVED HEAT RADIATION SHIELDING

[75] Inventors: Werner Bächler, Hoffnungsthal; Hans-Joachim Forth; Rudiger Frank, both of Cologne, all of Fed. Rep. of Germany

[73] Assignee: Leybold-Heraeus GmbH & Co. KG, Cologne, Fed. Rep. of Germany

Reexamination Request:
No. 90/000,642, Oct. 2, 1984

Reexamination Certificate for:

| | |
|---|---|
| Patent No.: | **4,121,430** |
| Issued: | **Oct. 24, 1978** |
| Appl. No.: | **793,488** |
| Filed: | **May 4, 1977** |

[30] Foreign Application Priority Data

May 11, 1976 [DE] Fed. Rep. of Germany ..... 2620880

[51] Int. Cl.[4] ..... B01D 8/00

[52] U.S. Cl. ..... 62/55.5; 55/269; 417/153; 417/901

[58] Field of Search ..... 62/55.5, 100, 268; 55/269; 417/153, 901

[56] References Cited

U.S. PATENT DOCUMENTS

| | | | |
|---|---|---|---|
| 3,338,063 | 8/1967 | Hogan et al. | 62/55.5 |
| 3,360,949 | 1/1968 | Blanchard et al. | 62/55.5 |

FOREIGN PATENT DOCUMENTS

| | | | |
|---|---|---|---|
| 1938035 | 2/1970 | Fed. Rep. of Germany | 62/55.5 |

*Primary Examiner*—Ronald C. Capossela

[57] ABSTRACT

A cryopump having a generally axially symmetrical housing provided at one end with an entrance opening defined by a plane for passage of molecules of the gas to be pumped and plates defining condensation surfaces arranged to be brought to low temperature for condensation of molecules of the gas to be pumped, and a thermal radiation shield disposed in the region of the entrance opening, with the condensation surfaces being oriented substantially at right angles to the plane of the entrance opening and the radiation shield being composed of a plurality of elongate metal strips so positioned that their longitudinal axes are parallel to the condensation surfaces.

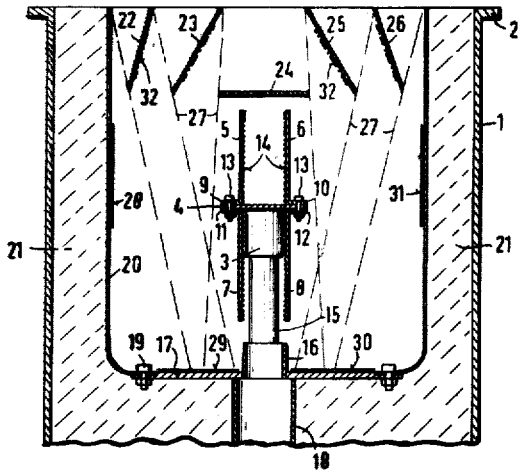

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–8 is confirmed.

Claims 1–4 and 9 are cancelled.

New claim 10 is added and determined to be patentable.

*10. In a cryopump composed of a housing presenting an entrance opening defined by a plane for passage of molecules of a gas to be pumped, a member arranged to be brought to low temperature and presenting planar condensation surfaces for molecules of the gas to be pumped, and a thermal radiation shield disposed in the region of the entrance opening, the improvement wherein said member is positioned so that said condensation surfaces are substantially at right angles to the plane of the entrance opening, and said radiation shield comprises a plurality of elongated metal strips so positioned that their longitudinal axes are parallel to the condensation surfaces, further wherein said member comprises two plates which face one another and extend through the pump housing, the surfaces of said plates which face away from one another constituting said condensation surfaces, and said member further comprising adsorption material covering only the surfaces of said plates which face one another, and further wherein the surfaces of said plates which face away from one another are arranged to be more accessible to molecules of gas entering the cryopump through said entrance opening than the surfaces of said plates which face one another.*

* * * * *